US005598621A

United States Patent [19]

Littecke et al.

[11] Patent Number: 5,598,621

[45] Date of Patent: Feb. 4, 1997

[54] METHOD OF MAKING METAL CUTTING INSERTS HAVING SUPERHARD ABRASIVE BODIES

[75] Inventors: Peter Littecke, Huddinge, Sweden; Ronald B. Crockett, Orem, Utah; Anders Thelin, Vällingby, Sweden

[73] Assignees: Smith International Inc., Houston, Tex.; Sandvik Aktiebolag, Sandviken, Sweden

[21] Appl. No.: 446,487

[22] Filed: May 22, 1995

[51] Int. Cl.[6] ..... B23P 17/00

[52] U.S. Cl. ..... 29/412; 51/293; 407/118; 407/119; 408/144; 408/145

[58] Field of Search ..... 29/411, 412, 414, 29/417; 408/144, 145; 407/116, 118, 119; 51/293

[56] References Cited

U.S. PATENT DOCUMENTS

| | | | |
|---|---|---|---|
| 2,002,229 | 5/1935 | Trembour et al. | 407/119 |
| 3,369,283 | 2/1968 | Colding | 407/118 |
| 4,437,800 | 3/1984 | Araki et al. | 407/118 |
| 4,504,284 | 3/1985 | Ohno | 51/293 |
| 4,866,885 | 9/1989 | Dodsworth . | |
| 4,991,467 | 2/1991 | Packer . | |
| 5,115,697 | 5/1992 | Rodriguez et al. . | |
| 5,183,362 | 2/1993 | Kuroyama et al. | 407/119 |
| 5,232,320 | 8/1993 | Tank et al. | 408/145 |

FOREIGN PATENT DOCUMENTS

| | | | |
|---|---|---|---|
| 4-336903 | 11/1992 | Japan | 408/145 |

*Primary Examiner*—David P. Bryant
*Attorney, Agent, or Firm*— Burns, Doane, Swecker & Mathis, L.L.P.

[57] ABSTRACT

A metal cutting insert is made by performing a sintering operation to form a substrate having a longitudinal axis and superhard abrasive bodies bonded thereto at longitudinally spaced locations. The substrate and superhard bodies are sliced-through in directions perpendicular to the axis to form inserts having superhard body portions on both side surfaces of the insert.

18 Claims, 2 Drawing Sheets

FIG. 6
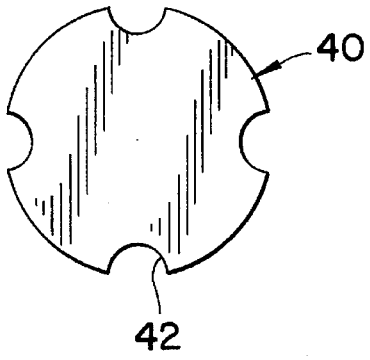
FIG. 7
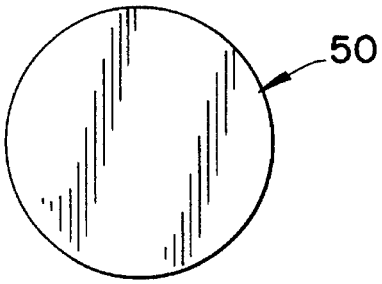
FIG. 8
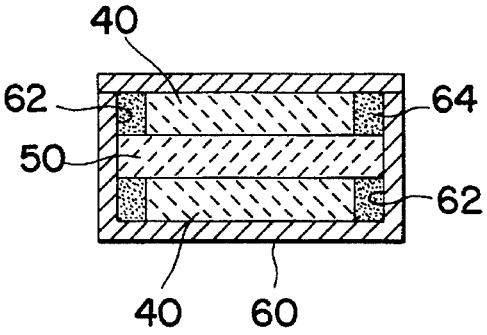
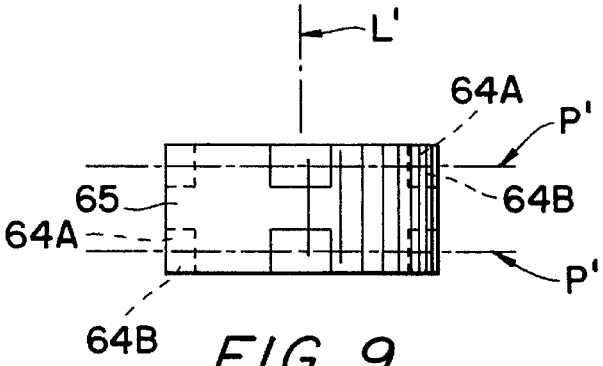
FIG. 9
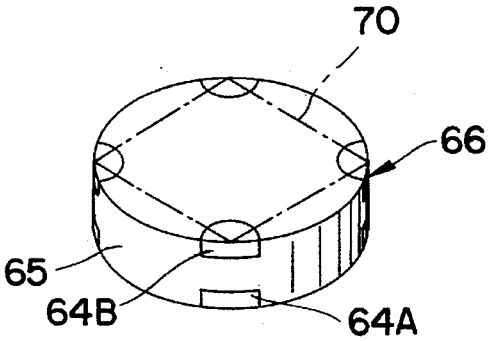
FIG. 10
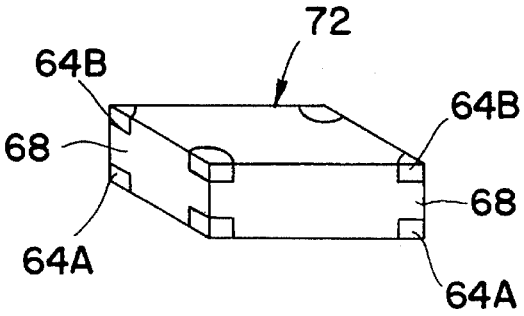
FIG. 11

METHOD OF MAKING METAL CUTTING INSERTS HAVING SUPERHARD ABRASIVE BODIES

RELATED INVENTION

This invention is related to that disclosed in U.S. application Ser. No. 08/446,490, filed May 22, 1995 (Attorney Docket No. 024444-120).

BACKGROUND OF THE INVENTION

The present invention relates to metal-cutting inserts having cutting edges formed of a superhard abrasive, such as polycrystalline cubic boron nitride (i.e., PCBN) or polycrystalline diamond (i.e., PCD), for example, and methods of making same.

Metal cutting inserts having cutting edges formed of a superhard abrasive, such as PCD, are usually used for the machining of non-ferrous alloys such as brass, magnesium and aluminum, and the like, whereas inserts with cutting edges formed of a superhard abrasive, such as PCBN, are usually used for the machining of cast iron and hardened steel and the like. The inserts are made in two different ways, namely (i) by sintering, under elevated pressure and temperature, a PCBN or PCD material into a solid body that is finished to form the final insert shape, or (ii) by bonding a layer of PCBN or PCD, under elevated pressure and temperature, to a substrate (usually a cemented carbide disc), from which smaller pieces (chips) are cut out. These chips are then brazed onto a regular carbide insert and ground to the finished size. Inserts are relatively expensive to produce in that way due to the many steps the product must undergo before it is finished. Also, usually only one or two superhard corners per insert are available.

Disclosed in Dodsworth U.S. Pat. No. 4,866,885 is a technique for making metal-cutting inserts wherein shallow recesses are formed in a surface of a cemented carbide substrate at locations spaced inwardly from an outer periphery of the substrate. Each recess is filled with hard abrasive particles such as PCD or PCBN. The substrate and abrasive particles are then subjected to a sintering operation at elevated temperature and pressure conditions, whereupon the abrasive particles become sintered to each other and bonded to the carbide body. The substrate is then severed along lines extending through the abrasive bodies parallel thereto to produce a multi-cornered cutting insert having a cemented carbide substrate and abrasive cutting bodies located on one side thereof. Among the shortcomings of such a procedure are that the insert has abrasive bodies on only one side. In order to provide such bodies on the other side, additional recesses would have to be formed in that other side and filled with superhard abrasive material. Also, the wire cutting involves an added step.

It would, therefore, be desirable to increase the number of abrasive bodies on an insert in order to decrease the cost per cutting corner, and to do so without unduly increasing the number of processing steps and overall manufacturing costs.

SUMMARY OF THE INVENTION

The present invention relates to methods of making a metal-cutting insert involving the steps of performing an elevated temperature and pressure treatment to form a substrate having a longitudinal axis and superhard abrasive bodies bonded thereto at longitudinally spaced locations, and slicing through the substrate and superhard abrasive bodies at the longitudinally spaced locations. The slicing is performed in directions oriented transversely of the longitudinal axis to form at least one insert comprised of a substrate having longitudinally spaced sides and longitudinally spaced superhard body portions disposed on respective ones of the sides.

Preferably, the substrate will have more than one superhard body at each longitudinal location so that the insert is formed with more than one superhard abrasive body portion on each side thereof.

The substrate may be multi-cornered, with the superhard abrasive bodies being disposed at respective corners thereof.

The elevated temperature/pressure treatment step is performed on a substrate arrangement comprised of a plurality of longitudinally adjacent layers, including a first layer situated between a pair of second layers. Each of the second layers has at least one recess formed in an outer peripheral edge thereof and extending for the full thickness of its respective second layer. Each recess forms a gap which is filled with a material possessing superhard abrasive particles. The layers of the substrate arrangement could be of one-piece construction, or separate pieces laid one upon the other.

BRIEF DESCRIPTION OF THE DRAWINGS

The objects and advantages of the invention will become apparent from the following detailed description of preferred embodiments thereof in connection with the accompanying drawings in which like numeral designate like elements and in which:

FIGS. 6–11 depict steps involved in the forming of metal-cutting inserts according to a second embodiment of the invention.

FIG. 1 is a perspective view of a substrate to be used in the first embodiment;

FIG. 2 is a view of the substrate of FIG. 1 following the removal of portions thereof to define vertically alternating substrate layers;

FIG. 3 is a side elevational view of FIG. 2 with the substrate disposed in a container (shown in phantom) and wherein recesses of the substrate are filled with a hard abrasive material;

FIG. 4 is perspective view of the substrate and abrasive material following an elevated pressure/temperature step and indicating planes through which the article is to be sliced;

FIG. 5 is a perspective view of a cutting insert resulting from the slicing operation shown in FIG. 4;

FIG. 6 is a plan view of a disk to be used as one type of substrate layer in the second embodiment;

FIG. 7 is a plan view of a disk to be used as another type of substrate layer;

FIG. 8 is a sectional view taken through a sintering container in which the disks of FIGS. 6 and 7 have been disposed, with spaces formed by the disk of FIG. 6 having been filled with a superhard abrasive material;

FIG. 9 is a side elevational view of the sintered substrate following the application of a sintering step, and depicting planes through which the substrate is to be sliced to form an insert;

FIG. 10 is a perspective view of the sintered substrate following a slicing step; and FIG. 11 is a perspective view of an insert produced by machining the sintered substrate of FIG. 10.

DETAILED DESCRIPTION OF PREFERRED EMBODIMENTS OF THE INVENTION

Figure 1:
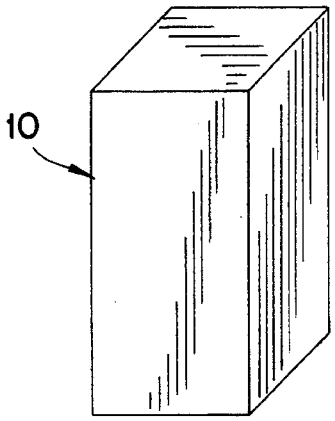
FIGS. 1–5 depict steps involved in the forming of metal-cutting inserts according to a first embodiment of the invention.
Figure 2:
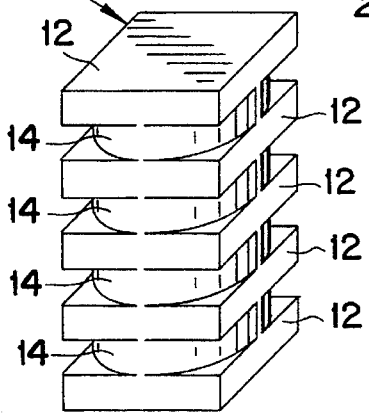
Figure 2A:
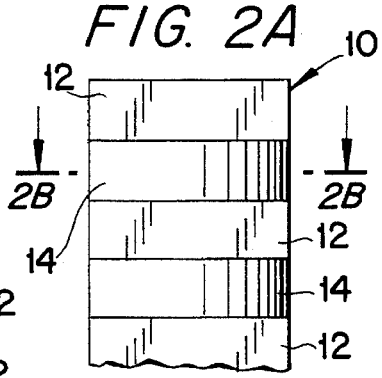
FIG. 2A is a side elevational view of an upper portion of FIG. 2.
Figure 2B:
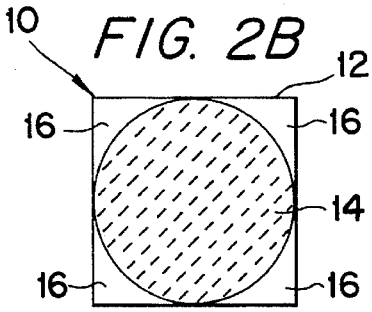
FIG. 2B is a sectional view taken along the line 2B—2B in FIG. 2A.

Depicted in FIG. 1 is a blank or substrate 10 in the form of a square block of a substrate material such as cemented carbide. Portions of the substrate are machined away to form a substrate arrangement 10A comprised of alternating first and second substrate layers 12, 14, respectively, as shown in FIGS. 2, 2A and 2B. The first layers 12 are of square configuration, and the second layers 14 are of cylindrical configuration, the outer periphery of each second layer being recessed relative to the outer peripheries of the first layers at four locations 16.

Figure 3A:
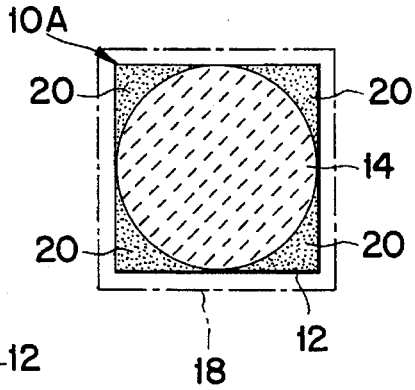
FIG. 3A is a sectional view taken along the line 3A—3A in FIG. 3.
Figure 3:
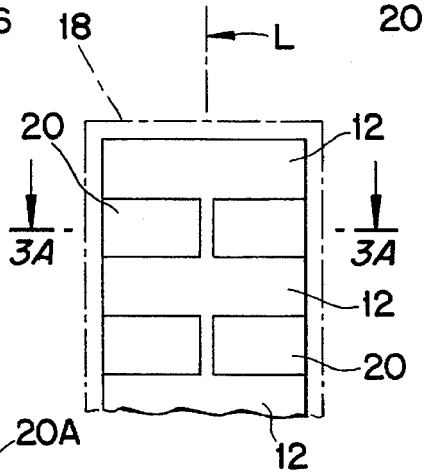

When the substrate is placed in a container 18 as shown in FIGS. 3 and 3A, the four recesses 16 form respective spaces each adapted to be filled with a material 20 having superhard abrasive particles such as PCD or PCBN for example. The material 20 can be in the form of a powder or pre-pressed green disks in the same shape as the spaces.

Then, the container and its contents are subjected to a conventional sintering (elevated temperature/pressure) step, whereupon the abrasive particles in each space become sintered together to form a superhard body which is bonded to its respective second layer 14 and to the first layers 12 disposed on opposite sides thereof.

Figure 4:
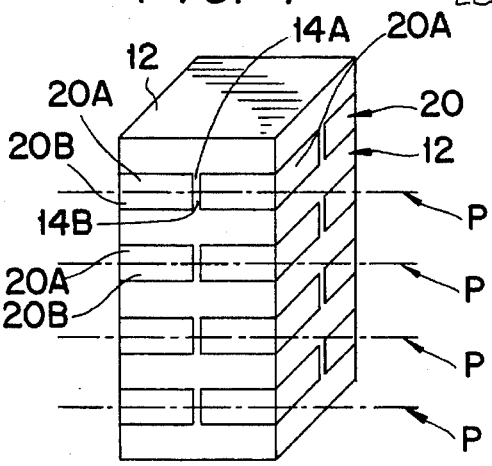
Figure 5:
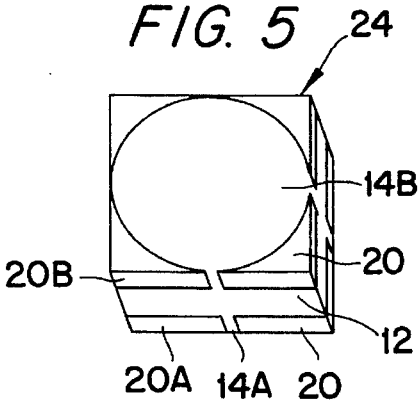

Thereafter, the sintered substrate arrangement is removed from the container and sliced to form individual inserts along planes P bisecting respective second layers 14 in directions parallel to the planes of those layers 14 (i.e., perpendicular to a longitudinal axis L of the substrate) as shown in FIG. 4. Accordingly, each of the superhard bodies 20 is divided into upper and lower body halves 20A, 20B, and each of the second layers is divided into upper and lower layer halves 14A, 14B (see FIG. 4). Following the slicing operation, which can be performed by an EDM wire, there is provided a plurality of inserts 24, each of which comprises a first layer 12, a half 14A of one second layer (with four abrasive body halves 20A associated therewith), and a half 14B of another second layer (with four abrasive body halves 20B associated therewith). Each side of the insert thus has four superhard bodies supported by a first layer 12.

It will be appreciated that inserts of any desired shape having a selected number of superhard bodies on each side surface could be formed by the present invention. The number of abrasive bodies and their location can be chosen in accordance with the type of insert that is to be produced. It would be preferable to provide as many abrasive bodies as possible to maximize the number of abrasive edges per insert.

The abrasive bodies themselves can be of any shape and located anywhere on the insert as long as the cutting work of the finished insert would be performed essentially by the abrasive bodies. Although the abrasive bodies located at the corners are symmetrical with respect to those corners, the bodies could instead be asymmetrically disposed with respect thereto. Abrasive bodies of the same or different shapes may be provided on the same insert. The abrasive bodies can, if desired, be reshaped (e.g., by grinding) after being bonded to the substrate.

The abrasive material 20 preferably comprises PCD or PCBN particles mixed with other hard and wear-resistant constituents such as carbides, nitrides, carbonitrides, oxides, borides of the metals of groups IVa to VIa of the periodical system preferably Ti as known in the art. A composition of MN90 could be used. The assembly is then subjected to conventional elevated temperatures and pressures for producing high pressure materials, e.g., as disclosed in U.S. Pat. Nos. 4,991,467 and 5,115,697 (the disclosures of which are incorporated herein by reference).

Since the cemented carbide substrate essentially does not take part in the cutting operation performed by the manufactured inserts, its composition is chosen such that it provides a good bond to the PCD or PCBN abrasive, is easy to grind and contains inexpensive components and suitable fracture resistance. Preferably, a cemented carbide having 10–20% Co by weight, most preferably about 15–17%, is used. Particularly good results have been obtained with a grade of 16%. Instead of cemented carbide, titanium based carbonitrides (so-called cermets) can be used. Inserts according to the invention can further be provided with thin wear resistant coatings preferably applied by conventional PVD or CVD methods.

A second embodiment of the invention is disclosed in connection with FIGS. 6–11. This embodiment may be preferred over that of FIGS. 1–5 in that the substrate subjected to the sintering process has no corners which can lead to the formation of stress fractures. Also, the substrate layers are not of one-piece construction, but rather are formed by individual disks 40, 50 depicted in FIGS. 6 and 7, respectively. The substrate layers 40 and 50 are round disks of generally the same size and shape, except that the layer 40 has four recesses 42 formed in its outer periphery.

The layers 40, 50 are positioned in a container 60 (see FIG. 8) in alternating fashion such that the recesses 42 form spaces 62. The spaces 62 are filled with a material 64 having superhard abrasive particles such as PCD or PCBN. The material can be in the form of a powder or pre-pressed green blanks.

Following the application of a conventional elevated temperature/pressure step, the abrasive particles become sintered together to form superhard bodies that are spaced apart longitudinally, i.e., spaced apart parallel to the longitudinal axis L of the member (see FIG. 9), and are bonded to the associated second layer 40 and the adjacent first layer 50. Also, the first and second layers become integrally bonded to one another to form an integral substrate 65 (see FIG. 9). The integral structure is then sliced, e.g. by an EDM wire, along parallel planes P' oriented parallel to the original planes of the substrate layers (i.e., perpendicular to a longitudinal axis L' of the integral structure). The planes P' are oriented such as to bisect the regions of the structure previously defined by the second layers 40. In so doing, the superhard hard bodies 64 are bisected into body halves 64A, 64B as shown in FIG. 9.

Following the slicing operation, there is provided an insert 66 comprised of: (i) a substrate 65 (formed by a previous first layer 50 and halves of two previous second layers 40), (ii) halves of two superhard bodies 64B on one side of the insert, and (iii) two superhard bodies 64A on the other side of the insert, as shown in FIG. 10.

Then, the insert is machined along lines 70 to form a multi-cornered insert 72 depicted in FIG. 11. The superhard body portions 64A, 64B will, when used in a cutting operation, be supported from below by a portion of the substrate.

It will be understood that inserts of any desired size and shape, having a selected number of super-abrasive bodies on each side, can be made in accordance with the embodiment described in connection with FIGS. 6–11.

It will be appreciated that the present invention enables inserts to be formed in a simplified manner to maximize the abrasive corner-per-insert ratio of the inserts.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A method of making a metal cutting insert comprising the steps of:

A) performing an elevated temperature and pressure operation to form a substrate having a longitudinal axis and superhard abrasive bodies bonded thereto at longitudinally spaced locations and;

B) slicing through said substrate and superhard abrasive bodies at the longitudinally spaced locations in directions oriented transversely of the longitudinal axis to form at least one insert comprised of a substrate having longitudinally spaced sides and longitudinally spaced superhard abrasive body portions disposed on respective ones of the sides.

2. The method according to claim 1, wherein the superhard bodies are PCD.

3. The method according to claim 1, wherein the superhard bodies are PCBN.

4. The method according to claim 1, wherein step A forms a substrate having more than one superhard body at each longitudinal location so that the insert is formed with more than one superhard abrasive body portion on each side thereof.

5. The method according to claim 1, wherein step A forms a round substrate and further comprising the step of machining the insert to a multi-cornered shape.

6. A method of making a metal-cutting insert having superhard cutting edges on respective sides thereof, comprising the steps of:

A) positioning in a container a substrate arrangement comprised of a plurality of substrate layers including a first layer situated between a pair of second layers, each of said second layers having at least one recess formed in an outer peripheral edge thereof and extending for the full thickness of its respective second layer, each recess forming a space in said container;

B) filling said spaces with a material possessing superhard abrasive particles;

C) subjecting the container to elevated temperature and pressure conditions to cause said superhard particles in each space to become sintered together into a superhard body bonded to said first layer and said second layers; and D) slicing said substrate arrangement along lines passing through respective second layers in directions parallel to the planes thereof to form an insert comprised of said first layer, a portion of each second layer, and a portion of each superhard body, whereby each second layer forms a side of said insert and includes a superhard cutting edge formed by said portion of a respective superhard body.

7. The method according to claim 6, wherein step A comprises positioning in said container a substrate arrangement whose first layer and second layers are of one-piece construction.

8. The method according to claim 7, wherein said second layers are of cylindrical shape, said first layer being of polygonal shape.

9. The method according to claim 6, wherein step A comprises positioning in said container a substrate arrangement whose first layer and second layers comprise individual pieces, and step C includes causing said second layers to become bonded to said first layer.

10. The method according to claim 6, wherein step A comprises positioning in said container a substrate arrangement including additional alternating first and second layers.

11. The method according to claim 6, wherein step A comprises positioning in said container a substrate arrangement wherein said first and second substrates are round disks.

12. The method according to claim 6, wherein step D comprises slicing centrally through said second layers.

13. The method according to claim 6, wherein step B comprises filling said spaces with said material in the form of a powder.

14. The method according to claim 6, wherein step B comprises filling said spaces with pre-pressed green disks.

15. The method according to claim 6, wherein step A comprises positioning in said container substrate arrangements formed of cemented carbide.

16. The method according to claim 6, wherein said material comprises PCD.

17. The method according to claim 6, wherein said material comprises PCBN.

18. A method of making a multi-cornered metal-cutting insert having superhard cutting edges on respective sides thereof, comprising the steps of:

A) positioning in a container a substrate arrangement comprised of a plurality of substrate layers including round first layers and round second layers, each first layer alternating with a second layer, each of said second layers having at least two recesses in an outer periphery thereof arranged in superimposed relationship to said first layer, said recesses forming spaces in said container;

B) filling said spaces with a material possessing superhard abrasive particles;

C) subjecting said container to elevated temperature and pressure conditions to cause said superhard particles in each space to become sintered together into a superhard body bonded to a respective second layer and to said first layer; and D) slicing said substrate arrangement along lines passing through centers of respective second layers in directions parallel to the planes thereof to form an insert comprised of said first layer, halves of said second layers, and halves of said superhard bodies, whereby said insert includes two sides formed by respective second layers, each side including superhard cutting edges formed by halves of said superhard bodies; and E) machining said insert into a multi-cornered configuration wherein portions of said halves of said superhard bodies are disposed at respective corners on each side of said insert.

* * * * *